US005209212A

United States Patent [19]

Viess et al.

[11] Patent Number: 5,209,212

[45] Date of Patent: May 11, 1993

[54] EXHAUST-GAS RECIRCULATION SYSTEM FOR AN INTERNAL COMBUSTION ENGINE

[75] Inventors: Walter Viess, Schwieberdingen; Hans Koehnle, Salzgitter, both of Fed. Rep. of Germany

[73] Assignee: Robert Bosch GmbH, Stuttgart, Fed. Rep. of Germany

[21] Appl. No.: 893,934

[22] Filed: Jun. 4, 1992

[30] Foreign Application Priority Data

Jun. 26, 1991 [DE] Fed. Rep. of Germany ..... 4121071

[51] Int. Cl.[5] ..... F02M 25/06

[52] U.S. Cl. ..... 123/571; 73/117.2

[58] Field of Search ..... 123/571; 73/117.2, 117.3

[56] References Cited

U.S. PATENT DOCUMENTS

| | | | |
|---|---|---|---|
| 3,850,151 | 11/1974 | Mawatari et al. . | |
| 4,060,065 | 11/1977 | Hata et al. . | |
| 4,531,499 | 7/1985 | Eckert et al. | 123/571 |
| 4,793,318 | 12/1988 | Tsurusaki | 123/571 |
| 4,870,941 | 10/1989 | Hisatomi | 123/571 |
| 4,967,717 | 11/1990 | Miyazaki et al. | 123/571 |

FOREIGN PATENT DOCUMENTS

| | | | |
|---|---|---|---|
| 3220832 | 12/1983 | Fed. Rep. of Germany . | |
| 3828477 | 3/1989 | Fed. Rep. of Germany . | |
| 0197461 | 11/1983 | Japan | 123/571 |
| 0170749 | 7/1989 | Japan | 123/571 |

*Primary Examiner*—David A. Okonsky
*Assistant Examiner*—M. Macy
*Attorney, Agent, or Firm*—Kenyon & Kenyon

[57] ABSTRACT

An exhaust-gas recirculation system includes means for diagnosing the system based upon temperature values measured in the exhaust-gas return duct when certain conditions exist. A differential value between the actual temperature in the exhaust-gas return duct and a reference temperature, which indicates the possible beginning of diagnosis, is provided for a flow-through test. The differential value is then fed to a low-pass filter. If the conditions for a diagnosis are satisfied, it is determined whether the recirculation system is in order based upon a comparison of the differential value to a threshold value. A leak test of the exhaust-gas return valve can likewise be performed based upon the differential value of the two temperatures.

7 Claims, 2 Drawing Sheets

EXHAUST-GAS RECIRCULATION SYSTEM FOR AN INTERNAL COMBUSTION ENGINE

FIELD OF THE INVENTION

The present invention relates to an exhaust-gas recirculation system. More specifically, the present invention relates to recirculation systems that include an exhaust-gas return valve, a temperature sensor, and a control unit.

BACKGROUND OF THE INVENTION

German Published Patent Application 38 28 477, titled "A Method and Device for Detecting Malfunctions in an Exhaust-Gas Recirculation System of an Internal Combustion Engine", describes a temperature sensor positioned after an exhaust-gas return valve. If certain conditions exist in the internal combustion engine's control system, that is, if an exhaust-gas recirculation took place for a certain period of time, a diagnosis of the system is made through a momentary scanning of the signal from the temperature sensor in an exhaust-gas recirculation duct.

U.S. Pat. No. 3,850,15 titled "Failure Warning Device for an Exhaust-Gas Recirculation System", provides for a warning to be output in case of a faulty exhaust-gas return valve. The error detection is likewise accomplished by a temperature measurement after the exhaust-gas return valve U.S. Pat. No. 4,060,065 describes a solution to the problem of estimating the quantity of recirculated exhaust gas based upon measured temperature values in the exhaust-gas return pipe. German Published Patent Application No. 32 20 832 describes a system having the same purpose using corresponding means.

However, known systems are not capable of providing optimum results in every situation. Therefore, the object of the present invention is to provide an exhaust-gas recirculation system which has means for diagnosing this system, and is able to reliably and optimally furnish information about its functioning.

SUMMARY OF THE INVENTION

The exhaust-gas recirculation system according to the present invention includes an exhaust-gas return valve located in an exhaust-gas return duct. A temperature sensor of the system measures the temperature in the duct. A difference value between the measured temperature value and a reference value is then determined. The system's low-pass filter receives a first variable based upon the measured load of the engine and a trigger signal of the valve, and a second variable based upon the difference value. The output of the low-pass filter is compared to a threshold value at a comparator of the system to determine whether a diagnosis of the system should be performed. If so, the difference value is also compared in a second comparator to a threshold value to determine whether the system is operating properly The exhaust-gas recirculation system according to the present invention reliably diagnoses exhaust-gas recirculation and incorporates the individual operating parameters of the internal combustion engine in such a way that an optimum functional test is attained.

DETAILED DESCRIPTION OF THE INVENTION

Figure 1:
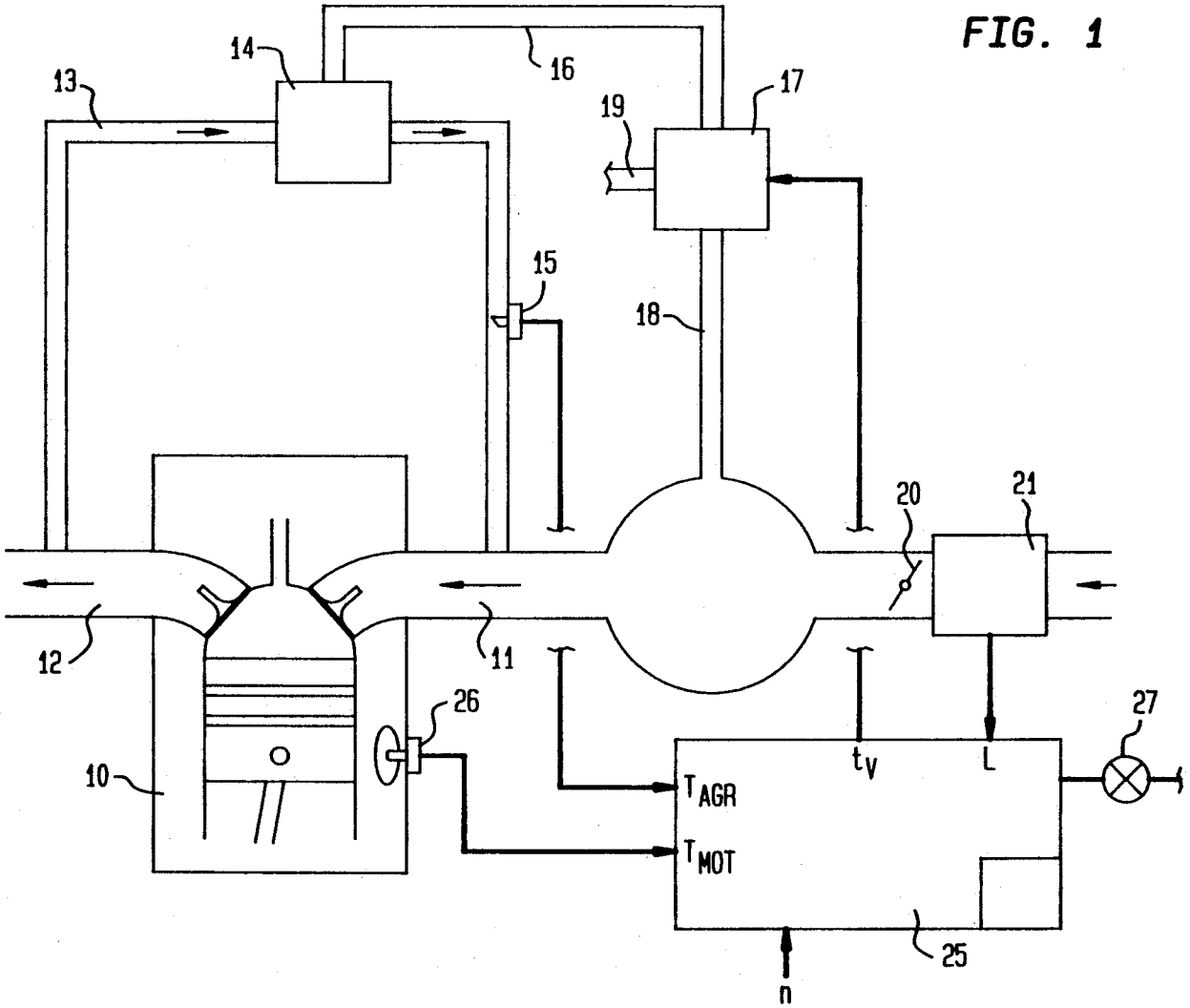
FIG. 1 shows a block diagram of an exhaust-gas recirculation system according to the present invention.

Referring to FIG. 1, the exhaust-gas recirculation system includes an internal combustion engine 10, a suction system 11, and an exhaust-gas line 12. Between the exhaust-gas line 12 and the suction system 11, there is an exhaust-gas return duct 13 with an exhaust-gas return valve 14, as well as a temperature sensor 15 positioned after the exhaust-gas return valve 14. The exhaust-gas return valve 14 is pneumatically connected via a duct 16 to an electropneumatic fixed-cycle valve 17. Fixed-cycle value 17 is connected on the input side via a duct 18 to the suction system 11 and, in addition, has a connection 19 leading to the surrounding air. A throttle valve 20, as well as a load sensor 21, is positioned before the point of entry of the duct 18 into the suction system 11.

An electronic control unit 25 receives signals from the load sensor 21, from the temperature sensor 15 in the exhaust-gas return line, as well as from a temperature sensor 26 on the internal combustion engine which essentially detects the coolant temperature of the internal combustion engine. The control unit also receives other signals relating to the operating parameters of the internal combustion engine, in particular to the rotational speed n. The control unit 25 outputs both a clock signal $t_v$ for the electropneumatic fixed-cycle valve 17 and a trigger signal for a warning lamp 27 to indicate an error in the exhaust-gas recirculation system.

In general, the control unit 25 performs even more functions within the scope of controlling the internal combustion engine, such as injection and ignition. However, these additional functions are not treated further within the scope of the present invention and, therefore, are not set forth in greater detail.

Figure 2:
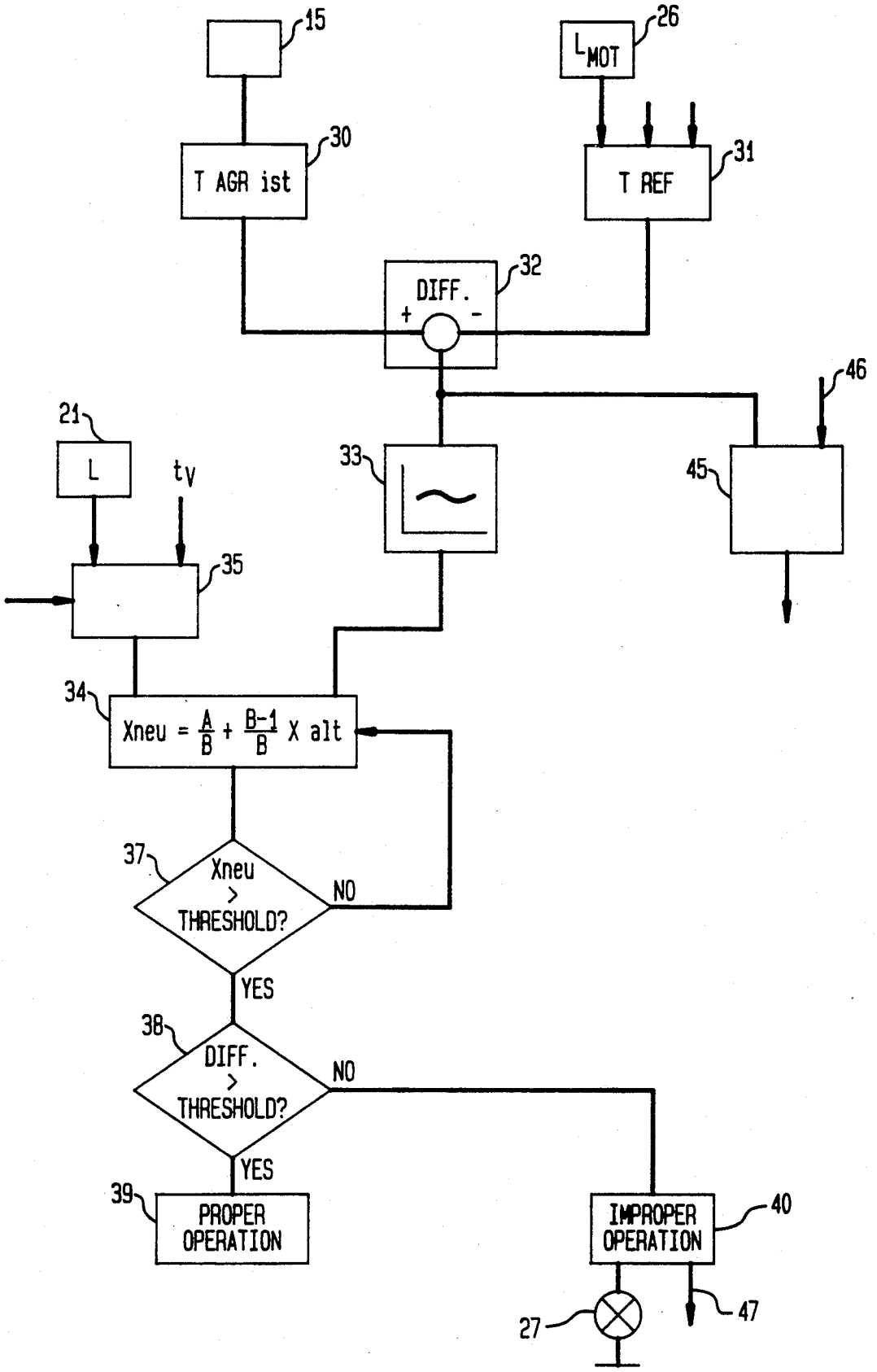
FIG. 2 shows a block diagram illustrating the mode of operation of a diagnosis according to the present invention.

A system similar to the system shown in FIG. 1 is described in German Published Patent Application No. 38 28 47. An important aspect of the present invention is the type and manner of the diagnosis of this exhaust-gas recirculation system, as illustrated in FIG. 2. The diagnosis essentially involves a flow test for the exhaust-gas return valve 14 upon the occurrence of certain conditions during the exhaust-gas recirculation. In addition, a leak test for the exhaust-gas return valve 14 can follow at times when the exhaust-gas return valve 14 is closed.

The block diagram of FIG. 2 shows the most important components in the signal pattern of the diagnosis according to the present invention. Criteria for the instant of the diagnosis are indicated and, furthermore, which variable should be monitored is determined.

Block 30 of FIG. 2 designates the detection of the temperature in the exhaust-gas return duct 15 (TAGRist) by means of the temperature sensor 15 positioned there. In block 31, based on the temperature of the internal combustion engine (TMOT) detected by the temperature sensor 26, a reference temperature TRef is determined. In a subtraction block 32, a comparison is made between the actual temperature in the exhaust-gas return line and the reference-temperature signal from block 31. The reference signal is subsequently fed to an input B of a low-pass filter 34 via a weighing block 33. The weighing in block 33 can be performed by means of a characteristic curve or a performance graph, and considers exceptional features of the internal combustion engine and its exhaust-gas recirculation system.

Block 35 generates a signal which is dependent upon load signals from the load sensor 21, as well as upon the pulse-duty factor of the trigger signal of the electropneumatic transducer. This signal is fed to an input A of the low-pass filter 34. In addition, it is advantageous if an altitude signal which can be extracted, for example, from the atmospheric pressure also is processed.

A continuous calculation takes place in the low-pass filter in accordance with the following expression:

$$Xneu = A/B + ((B-1)/B)*Xalt \quad (1)$$

where A represents the first input signal of the low-pass filter 34 transmitted from block 35, and B the second input signal transmitted from the weighing block 33.

The calculated signal Xneu is subsequently scanned to check whether a threshold has been exceeded. If, in block 37, the threshold is reached, the conditions for a diagnosis are satisfied. An actual diagnosis follows in block 38, in which it is determined whether the differential value obtained in the subtraction block 32 has reached a threshold. If so, block 39 indicates that the flow rate through the exhaust-gas return valve 14 is in order. However, if the differential value has not yet reached the threshold in block 38, block 40 indicates that an error in the exhaust-gas recirculation system has been detected, and the warning lamp 27 is triggered accordingly. In addition, further measures can be taken by way of a further output 41 in order to enable emergency operation with a reduced amount of exhaust emissions.

Importantly, a temperature differential value (output signal from the subtraction block 32) for determining the instant of the diagnosis, as well as for performing the diagnosis itself, is processed. The low-pass filter processes this temperature differential value with reference to load-dependent values, as well as other variables specific to the internal combustion engine, such as TMOT. Block 37 establishes an instant, or an operating state, in which the diagnosis is supposed to be made. Low-pass filtering takes place until the threshold is reached. However, if Xneu reaches this threshold, a diagnosis possibly begins, in which the difference between the actual temperature in the exhaust-gas pipe and the reference temperature TRef is important. A positive or negative result is indicated dependent upon this difference.

It is particularly advantageous if, in addition to a load value and the trigger value for the electropneumatic transducer 17, an altitude signal is processed in block 35, because the load-dependent backflow of exhaust gas varies dependent upon altitude, and, therefore, the conditions for undertaking the diagnosis can change.

In block 45 a leak test may be performed on the exhaust-gas return valve. The leak test also makes use of the differential temperature resulting from the subtraction 32. At least one signal indicating a closed exhaust-gas return valve (marked by arrow 46) must be processed as an additional variable. Dependent upon the leak test, a signal at the output of block 45 can be measured. This signal indicates the imperviousness of the exhaust-gas return valve, as discussed in U.S. Pat. No. 3,850,181 mentioned above.

The terms and expressions which are employed herein are used as terms of expression and not of limitation. And, there is no intention, in the use of such terms and expressions, of excluding the equivalents of the features shown, and described, or portions thereof, it being recognized that various modifications are possible within the scope of the invention.

What is claimed is:

1. An exhaust-gas recirculation system for an internal combustion engine, comprising:

an exhaust-gas return valve located in an exhaust-gas return duct;

a load sensor for measuring at least one operating parameter of the internal combustion engine;

a temperature sensor for measuring a temperature in the exhaust-gas return duct;

a control unit coupled to the load sensor for controlling the exhaust-gas return valve based upon the measured operating parameters;

means for determining a difference value between the measured temperature value in the exhaust-gas return duct and a preselected reference value;

filter means for receiving a first variable based upon at least one of a measured load of the engine and a trigger signal of the exhaust-gas return valve, for receiving a second variable based upon the difference value, and for generating a filtered output value based thereon; and means for comparing the filtered output value to a first preselected threshold value and for performing a diagnosis of the exhaust-gas recirculation system based thereon by comparing the difference value to a second preselected threshold value.

2. The system as recited in claim 1, wherein the second variable is dependent upon an altitude.

3. The system as recited in claim 1, wherein the preselected reference value is dependent upon the temperature of the engine.

4. The system as recited in claim 1, wherein the filtered output value is determined according to the following expression:

$$A/B + ((B-1)/B)*alt$$

where A refers to the first variable, B refers to the second variable, and alt refers to an altitude.

5. The system as recited in claim 1, further comprising means for weighing the difference value.

6. The system as recited in claim 1, further comprising means for performing a leak test on the exhaust-gas return valve based upon the difference value.

7. The system as recited in claim 1, wherein the filter means is a low-pass filter.

* * * * *

UNITED STATES PATENT AND TRADEMARK OFFICE

CERTIFICATE OF CORRECTION

PATENT NO. : 5,209,212

DATED : May 11, 1993

INVENTOR(S) : Veiss et al.

It is certified that error appears in the above-indentified patent and that said Letters Patent is hereby corrected as shown below:

Column 1 line 26, change "No. 3,850,15" to --No. 3,850,151--;
line 31, change "valve" to --valve.--;
line 62, change "properly" to --properly.--.

Signed and Sealed this

Twenty-fourth Day of May, 1994

Bruce Lehman

*Attest:*

BRUCE LEHMAN

*Attesting Officer*

*Commissioner of Patents and Trademarks*